US005088269A

United States Patent [19]

Thelen

[11] Patent Number: 5,088,269

[45] Date of Patent: Feb. 18, 1992

[54] PROCESS AND APPARATUS FOR PRODUCING A SANITARY CARRIER FOR A PLURALITY OF CONTAINERS

[75] Inventor: Brian L. Thelen, Fond du Lac, Wis.

[73] Assignee: Nigrelli Systems, Inc., School Hill, Wis.

[21] Appl. No.: 617,685

[22] Filed: Nov. 26, 1990

[51] Int. Cl.[5] ..... B65B 21/00; B65B 53/00

[52] U.S. Cl. ..... 53/398; 53/441; 53/556; 53/48.2

[58] Field of Search ..... 53/48, 398, 441, 453; 53/464, 487, 556, 559, 580, 141, 48.1, 48.2

[56] References Cited

U.S. PATENT DOCUMENTS

| | | | |
|---|---|---|---|
| 2,874,835 | 2/1959 | Poupitch . | |
| 2,929,181 | 3/1960 | Poupitch . | |
| 2,936,070 | 5/1960 | Poupitch . | |
| 3,032,944 | 12/1959 | Hull et al. . | |
| 3,044,230 | 7/1962 | Fisher . | |
| 3,046,711 | 7/1962 | Harrison . | |
| 3,134,485 | 5/1964 | Bonkowski et al. . | |
| 3,200,944 | 8/1965 | Rapata . | |
| 3,206,019 | 9/1965 | Curry et al. . | |
| 3,355,013 | 11/1967 | Poupitch . | |
| 3,742,677 | 7/1973 | Best | 53/398 |
| 3,744,626 | 7/1973 | Dreyfus | 53/398 X |
| 3,871,699 | 3/1975 | Hatfield . | |
| 4,116,331 | 9/1978 | Curry et al. . | |
| 4,281,502 | 8/1981 | Bonkowski | 53/398 |
| 4,688,367 | 8/1987 | Bonkowski | 53/398 |

*Primary Examiner*—John Sipos
*Assistant Examiner*—Linda B. Johnson
*Attorney, Agent, or Firm*—Francis J. Bouda

[57] ABSTRACT

The process and apparatus of the present invention includes a conveyor for applying a continuous sheet of plastic to the tops of a plurality of beverage containers, the tops and chines of which are smaller than the outer diameters of the containers. A heating element applies heat through openings in a mask placed between the heater and the plastic and softens portions of the plastic in areas in alignment with the tops of the containers but smaller than the container tops. An unsoftened portion of the plastic surrounds the softened portion in alignment with the chines of the containers and a forming plate pushes the plastic sheet against the container tops so that the softened portion is above the tops, and the unsoftened portion snaps around and beneath the chines. A careful disposition of the openings in the masks and the heating elements insures that the plastic is not softened in the areas above the chines which must snap around and beneath the chines to hold the plastic in place after the forming plate is removed.

2 Claims, 6 Drawing Sheets

PROCESS AND APPARATUS FOR PRODUCING A SANITARY CARRIER FOR A PLURALITY OF CONTAINERS

BACKGROUND OF THE INVENTION

The plastic carrier for a plurality of containers is well-known, quite often referred to as the carrier for a "six-pack or "12-pack" of containers of soft drinks or beer and the like. Such plastic carriers enable a person to carry a plurality of the containers as a single unit and the development of this type of carrier is clearly shown in the prior art as, for instance, by Poupitch in U.S. Pat. Nos. 2,874,835; 2,929,181 and 2,936,070; by Hall et al in U.S. Pat No. 3,032,944; by Fisher in U.S. Pat. No. 3,044,230; by Dreyfus in U.S. Pat. No. 3,744,626; by Curry et al in U.S. Pat. Nos. 3,134,485 and 3,206,019; and by Bonkowski in U.S. Pat. Nos. 4,281,502 and 4,688,367. In addition, carriers which incorporate a cover of some type over the containers are disclosed by Harrison in U.S. Pat. No. 3,046,711; by Rapata in U.S. Pat. No. 3,200,944; by Poupitch in U.S. Pat. No. 3,355,033; by Hatfield in U.S. Pat. No. 3,871,699; and by Curry et al in U.S. Pat. No. 4,116,331. The most popular of the carriers is illustrated in FIG. 1 of this application, which shows the prior art devices which do not have a protective cover for the top of the containers.

The prior art in which a protective cover of some sort, generally a two-piece system, is illustrated in the prior art as shown in FIGS. 2 and 3 of this application.

The popularity of these "6-pack" carriers is universal but, unfortunately, they have several disadvantages. The most disturbing of these is the fact that the perforated carrier as shown in the prior art illustrated in FIG. 1 is generally carelessly discarded after the containers have been removed, and the carrier is so ubiquitous that it has created an environmental problem of international significance. Not the least of these is the fact that the carrier is generally non-degradable, and wherever it is discarded it will never disappear, but, more importantly, the discarding of these devices quite often takes place in an environment where animals, either by curiosity or by accident, become ensnared in the openings, are unable to remove the carrier, or release themselves from engagement therewith, and quite often die a horrible death as a result of such entrapment.

A second disadvantage of the prior art is that the device as shown in FIG. 1, although providing an inexpensive carrier for the containers, do not protect the top of the containers from dirt or dust or being otherwise soiled, as quite often these multi-packs are stored in unclean areas.

The devices shown in the prior art illustrated in FIGS. 2 and 3 provide a more sanitary carrier, but in addition to the perforated sheet which provides the carrier mechanism, they also require a second overlay sheet which rests on top of the perforated carrier and overlies the tops of the cans. Thus the multi-ply characteristic of this device makes it expensive from a material standpoint and also from a production standpoint.

More effective in providing a sanitary carrier has been the single-ply sheet-carrier shown in FIG. 4 ( see also the Bonkowski Pat. Nos. 4,281,502 and 4,688,367, both of which are incorporated herein in their totality by reference).

Bonkowski shows in his prior art disclosures how a single plastic sheet can be thermally treated and forced over the top of the containers, with portions thereof resting beneath the chine of the cans, and thus simultaneously providing a carrier and a protective cover. A typical Bonkowski cover-carrier is shown in the prior art illustration of FIG. 4 of this application.

Although general reference has been made to a covercarrier for a plurality of containers, it is to be understood that the cover-carrier of this invention is equally applicable to carrying a plurality of bottles of glass or plastic, such as used for the dispensing of motor oil, condiments, foodstuffs, and the like.

Another object of the present invention is to provide an improved machine for producing a carrier-container which has the sanitary aspect of protecting the tops of the containers from contamination, and which also can be environmentally effective, insofar as the material used therein is both made from a recyclable plastic and also can, after use, be once again recycled.

Another object of the present invention is to provide the apparatus for applying a cover-carrier to a plurality of containers at high speed.

Another object of the present invention is to provide an apparatus for applying cover-carriers to a plurality of containers, said apparatus being constructed and arranged so as to intermesh with high-speed can filling and packaging apparatus.

SUMMARY OF THE INVENTION

In the present invention, a machine or system is provided which can be attached to the discharge end of a high-speed, container filling line. The machine applies a single-ply cover-carrier sheet using heating facilities for selectively preparing a plastic sheet as an array of containers passes through the cover- applying apparatus. The apparatus sorts and arranges the containers, as desired in groups of 6, 12, 24 or the like, before the application of the cover-carrier. After the cover-carrier is applied to the tops of the containers, the apparatus thereafter selectively determines whether any of the containers have been improperly covered and secured and, if so, rejects such containers and automatically eliminates that unit from the down-stream end of the subsequent packaging device.

The apparatus of the present invention also unwinds the plastic cover-carrier material from supply-rolls in a manner which continuously and uniformly feeds individual cover-carrier portions onto a carrier which passes through a heating station and then deposits the cover-carrier onto the tops of the containers. The mechanism can also detect whether a cover-carrier is missing in its sequence, and automatically retain the array of containers in place until the next cover-carrier arrives or, in any event, indicate that a non-covered array of containers has passed through the apparatus of the present invention.

In the applying of the heat-energy to the plastic sheet, prior to its attachment to the containers, the apparatus includes a plurality of pocket plates which hold the containers in accurate positions underneath the plastic sheet as it is applied thereto, and also a unique forming die plate which clamps the plastic sheet in place and provides a mask/heat-sink arrangement so that the plastic sheet receives selected areas of heat of differing intensity, whereby the plastic sheet as it is applied over the container is nonuniformly softened for reasons to be described hereinafter.

The pocket plate and forming die are mechanically interlocked for positive registration during the forming operation.

With the above and other objects in view, further information and a better understanding of the present invention may be achieved by referring to the following detailed description:

DETAILED DESCRIPTION

For the purpose of illustrating the invention, there is shown in the accompanying drawings a form thereof which is at present referred, although it is to be understood that the various instrumentalities of which the invention consists can be variously arranged and organized, and that the invention is not limited to the precise arrangement and organizations of the instrumentalities as herein shown and described.

In the drawings, wherein like reference characters indicate like parts:

FIG. 1 is a perspective view of a can-carrier of the prior art.

FIGS. 2 and represent a perspective view and a vertical cross-sectional view of a 2-ply protective cover-carrier of the prior art.

Figure 13A:
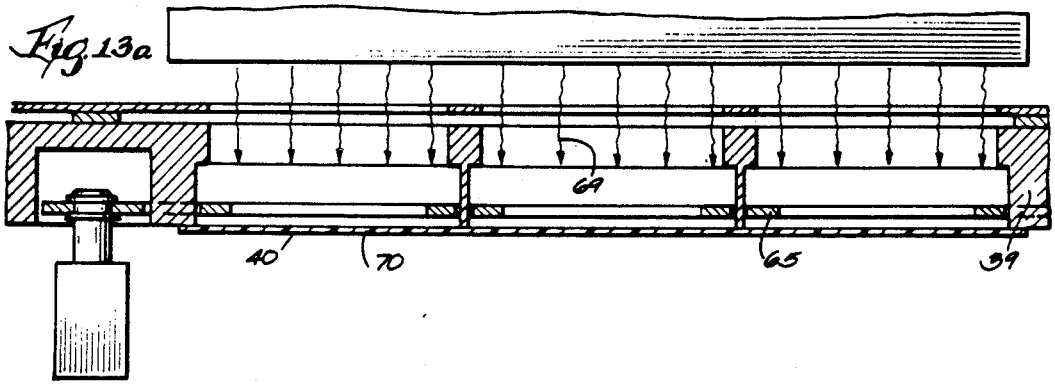

FIGS. 13*a, b, c,* and *d* illustrate schematically the step-wise application of heat to the plastic sheet, the contact of the plastic sheet with the container tops, the operation of the mask around the top of the containers, and the ejection of the area-cover in the cans therefrom.

Figure 1:
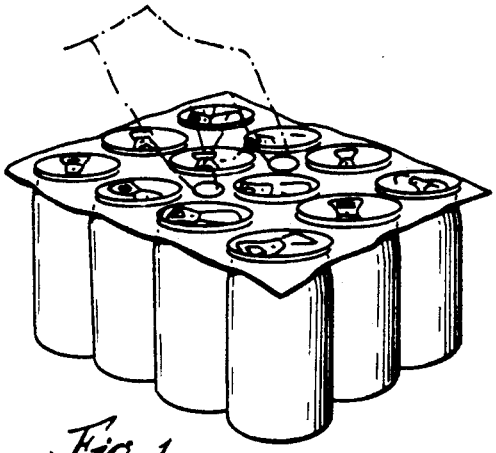
Fig. 1 PRIOR ART
Figure 3:
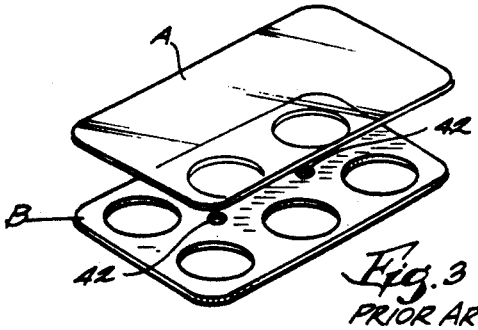
Fig. 3 PRIOR ART
Figure 2:
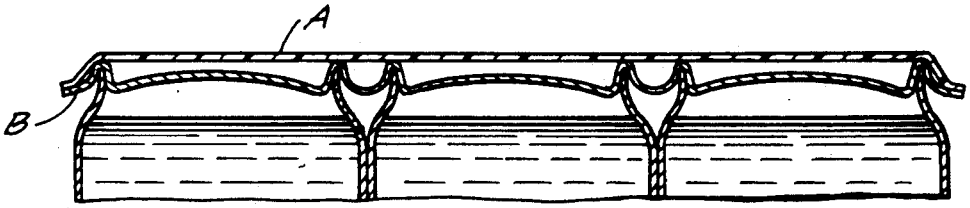
Fig. 2 PRIOR ART
Figure 14:
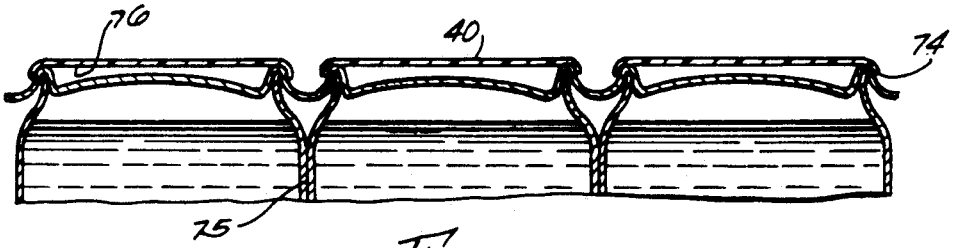
Fig. 14 PRIOR ART

FIG. 14 is a vertical cross-sectional view showing the assembly of one of the single ply carrier-covers of prior art to a plurality of containers.

Figure 15:
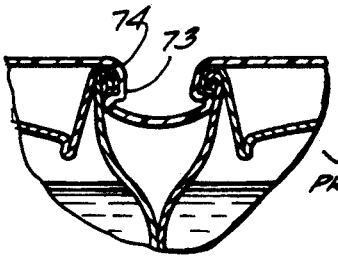
Fig. 15 PRIOR ART

FIG. 15 is an enlarged view showing how the single ply carrier-cover of the present invention interlocks around the chine of the containers and holds two containers in side-by-side assembly.

Figure 16:
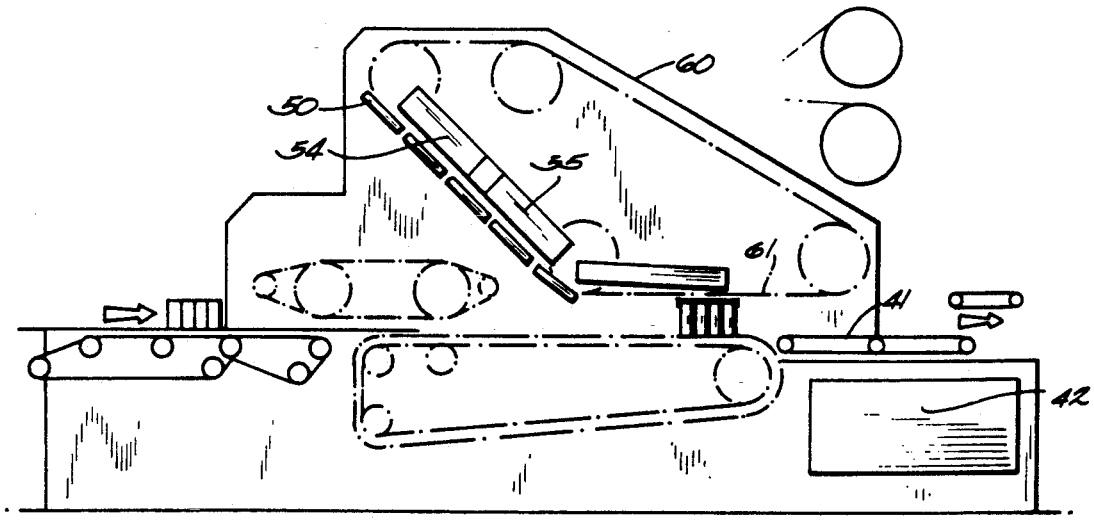

FIG. 16 is a schematic vertical cross-sectional view of the apparatus of the present invention illustrating the heat-applying sections, and the outfeed/missing blank reject section.

Figure 5:
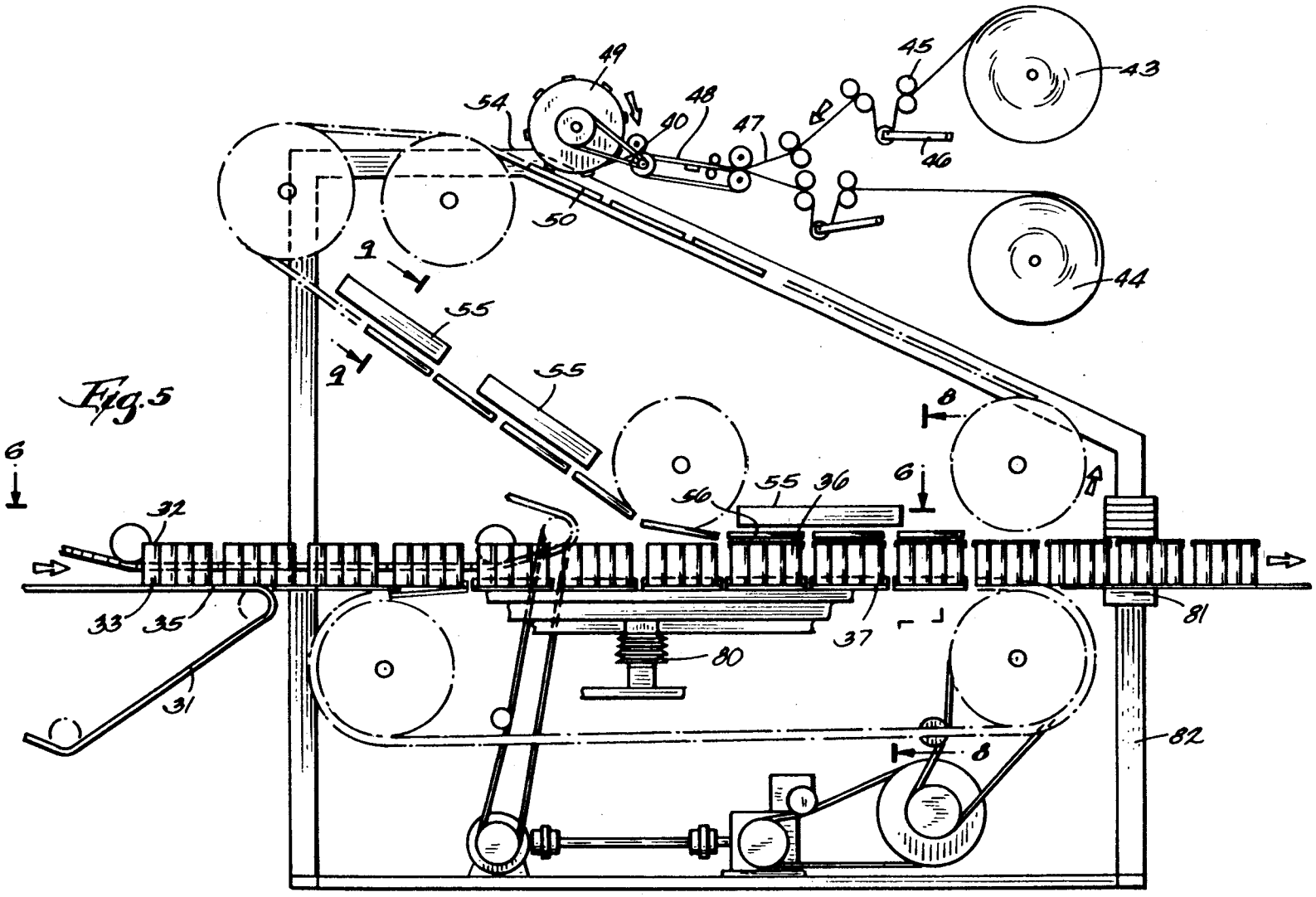
FIG. 5 is a vertical cross-sectional view of the cover-applying apparatus of the present invention.
Figure 6:
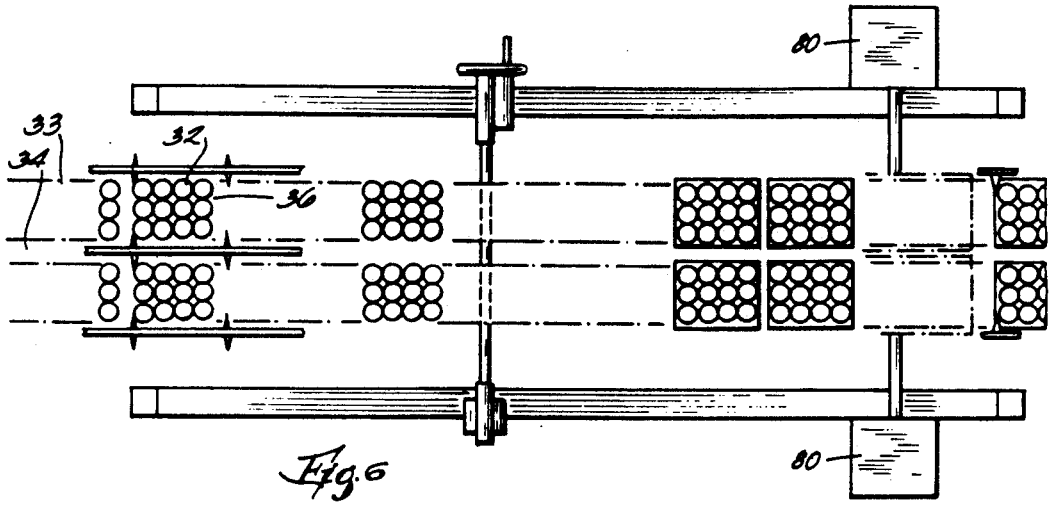
FIG. 6 is a top plan view, partly in section, of the apparatus of FIG. 5, taken generally along line 6—6 of FIG. 5.
Figure 7:
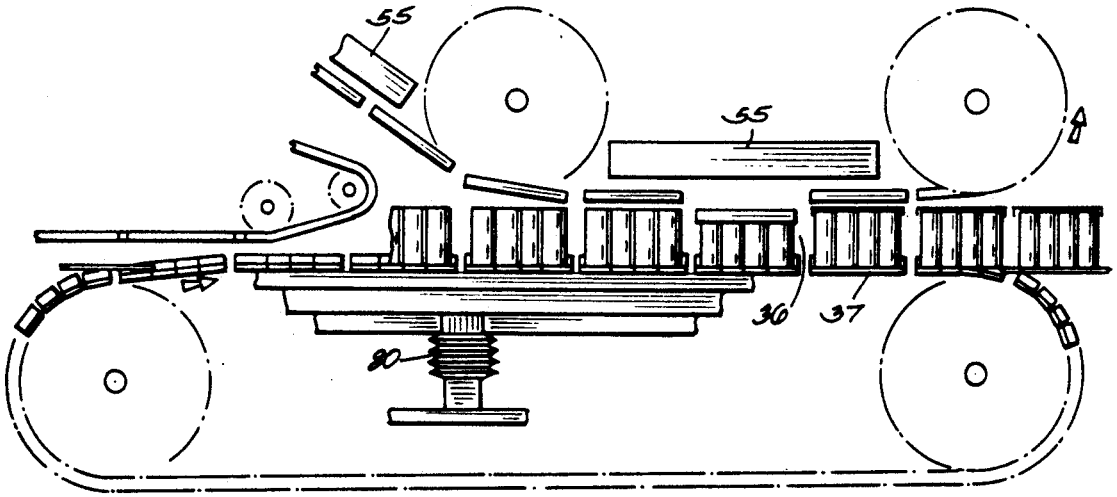
FIG. 7 is a larger view of the cover-applying section of the apparatus shown in FIG. 5.

Referring now to FIG. 5, there is shown at 31 a conveyor belt which brings a plurality of containers 32 to the in-feed end 35.

The containers or product 32 to be packaged are brought into the machine via a split double three-wide per side side-off transfer 33. The machine is essentially a 6-wide configuration with a gap 34 down the middle. The 3-wide lane configuration allows either a 6-pack, a 12-pack, or other counts to be formed by the machine.

Figure 11:
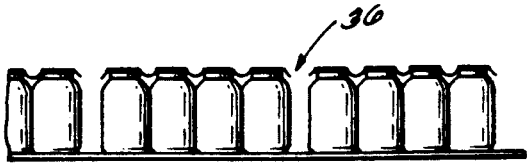
FIG. 11 illustrates how a plurality of containers are grouped in units as the containers pass through the apparatus of the present invention.

The containers ar then grouped at the end 35 of the infeed 33 using a series of bottom lug groupers (not shown). These groupers assemble 24 containers in two 3-wide ×4-long 12-packs (or the required count). When product is required, the groupers cycle forward, pushing the container groups into the machine. As the two parallel can groups move forward, they are picked up by an accelerator grouper (not shown) which propels them forward and provides about 1.5" of gap 36 between groups (see FIG. 11).

As the gap generated by the accelerated groupers moves further into the machine, overhead pusher bars (not shown) move down into those gaps. As the pusher bars push the product forward, the bottom lug groupers move down and out of the way. The pusher bars move the product forward to where the containers are loaded into a precise gripping and locating pocket plate transport system 37. The cans are lowered into the pocket plate by sliding them down individual lane loading fingers (not shown).

The pocket plates hold the containers in an accurate grouping for the forming operation. As the pocket plates 37 move through the machine, a locating pin 38 within them is moved upwards, mating the pocket plate 37 with an overhead forming die plate 39. The pocket plate segments 37 may be held together by flexible flat spring stock to maintain size integrity for the container group during the forming operation. After the plastic blank 40 is thermoformed on the container group, the forming die plate 39 is raised, disengaging the locating pin 38. The pocket plates 37 are then moved forward while the array of containers is separated from the plates 37 by a stationary set of unload fingers (not shown).

As the required pack arrays leave the pocket plates 37, they are transferred to a "missing blank" tabletop chain outfeed 41. The tabletop chains 41 support the array only under the outer two rows of containers. This verifies that a plastic blank 40 has captured the center row of containers. If not, the center row falls through the conveyor into a catcher 42 below. The next section of conveyor moves the array by supporting only the center row of containers on tabletop chain, and any unpackaged outer rows of containers drop through into the catcher 42.

Plastic blanks 40 are supplied in rolls 43/44 for ease in handling and loading. After a roll (e.g. 43) is put in position, the end is threaded through a nip roller 45 and dancer arm 46 to a "ready" position 47. When the other roll 44 runs out, the "spare" roll 43 which has been staged, is automatically fed into the system 48 to continue uninterrupted operation. This allows the operators some latitude in timing the roll loading because the transition from one roll to the next is automatic. The web of plastic material feeding from the rolls is indexed at a fixed pitch. When the web reaches the end of the belt feed 48, the hand-off system 49 changes the operating pitch to the pitch required for the containers being shaped. This pitch-change snaps the individual plastic blanks 40 apart, and also places the blanks 40 on an adjacent moving die plate 50.

As mentioned above, the hand-off system 49 supplies blanks 40 to the series of forming die plates 39. As the forming plates 39 move into the hand-off plastic loading area 49, clamps 51 on the leading edge 52 and trailing edge 53 of the forming plate 39 are cammed open to receive the plastic blank 40. Wire guides (guide skis) (not shown) push the blank 40 against the surface of the forming plate 39. Once the plastic sheet 40 is in place, the clamps 51 close, holding the plastic sheet 40 in place for heating and forming.

The forming plate 39 with the plastic sheet 40 then moves across the infra-red plastic heating system 54. the intensity of the heating elements 55 is a variable, being adjusted up or down corresponding to machine speed. As the forming plate 39 moves into a horizontal path 56 above the containers, it is guided downward in a forming motion, simultaneously forming the plastic blanks 40 into two cover-carriers over two packages of the required count.

Following the forming operation, as the forming plate 39 is moved away from the containers, the plastic clamps 51 are opened, freeing the package from the forming plate 39.

During the entire forming operation, the locating pins 38 in the lower pocket plates 37 are inserted into mating holes 57 in the forming plate 39. This action maintains positional integrity between the upper and lower portions of the forming pocket and die.

The entire forming superstructure is mounted on lift jacks which adjust it for different can heights. The jacks are used only for lifting/lowering from a common handwheel. Height is maintained using spacers 81, in the vertical legs 82, to ensure stability.

If desirable or necessary, following the forming operation, the forming plate may pass through a water bath (not shown) to neutralize its temperature.

The machine is equipped with automatic controls to slow down, accumulate, or stop, in the event a downstream blockage occurs. Downstream sensors can be arranged for slow down and run out, or stop and run out, depending on space available.

Additionally, a set of sensors (not shown) located near the machine input indicate sufficient product to begin running.

The machine can operate at least 3 forward speeds. As the machine speed increases, the power to the heating lamps also increases, commensurate with the machine speed.

The reduced heat is prevented from affecting the plastic sheet 40 beyond the diameter of the opening 71 by both the mask 65 and the forming plate 39.

The mask 65 prevents the plate 39 from becoming heated near the plastic sheet 40. The mask 65 can be of various vertical dimensions, depending on product being packaged. It may be a relatively flat sheet, as shown at 65 in FIG. 13*a* and 13*d*, or a relatively deeper shield, as shown at 65*a* in FIGS. 13*b* and 13*c*. It may extend upwardly from the plastic sheet 40 as far as desired within the opening 39*a* in the plate 39.

When an emergency stoppage occurs, all machine motion stops and all power to the heater lamps 55 is shut off.

Figure 8:
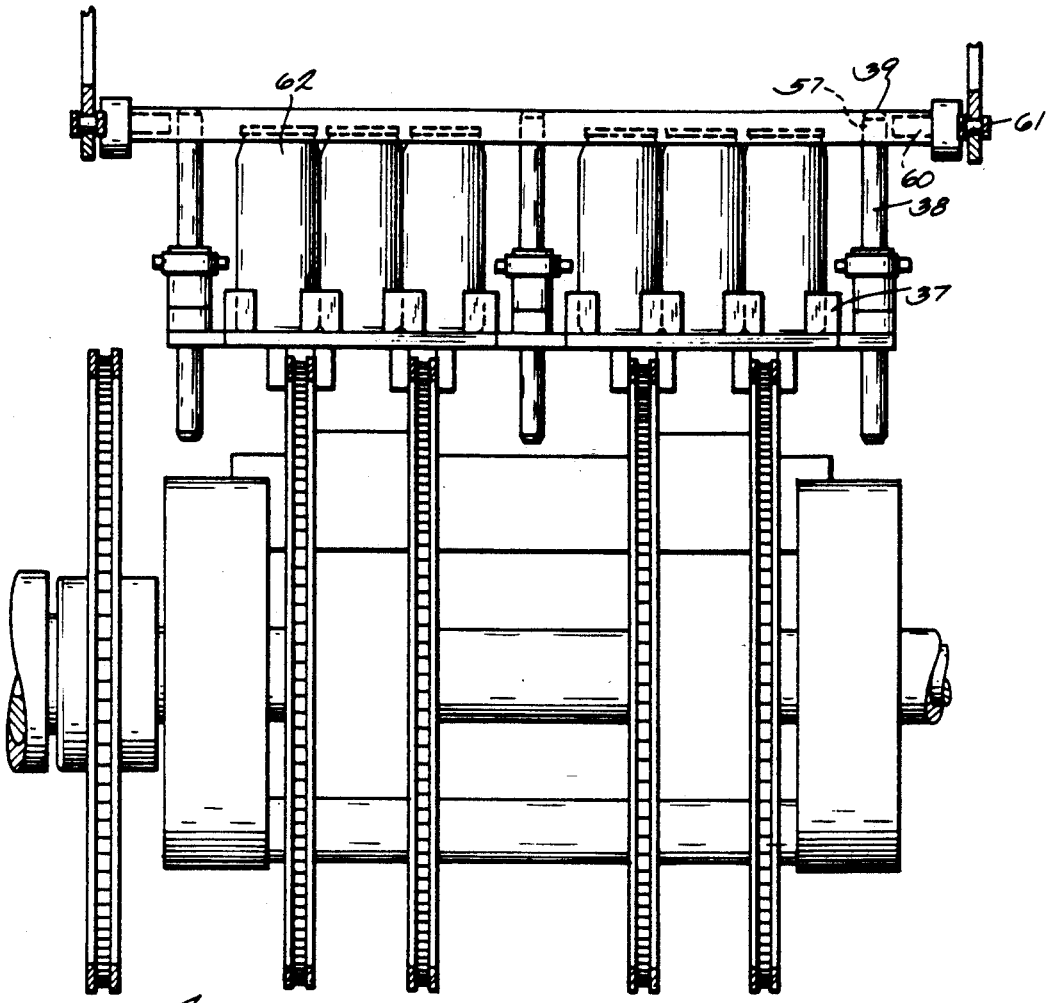
FIG. 8 is a vertical sectional view taken generally along lines 8—8 of FIG. 5 illustrating how the apparatus brings the cover-carrier plastic sheet into contact with the upper surfaces of the containers.

With reference to FIG. 8, one may see how the array of containers held in the pockets 37 become engaged with the plate 39 as the plate 39 is moved closer to the top of the container. The illustration in FIG. 8 shows how the generally horizontal run 61 of the belt 60 can be adjusted up and down (as previously described) to accommodate short container 62, medium length container 63, or tall container 64.

Figure 10:
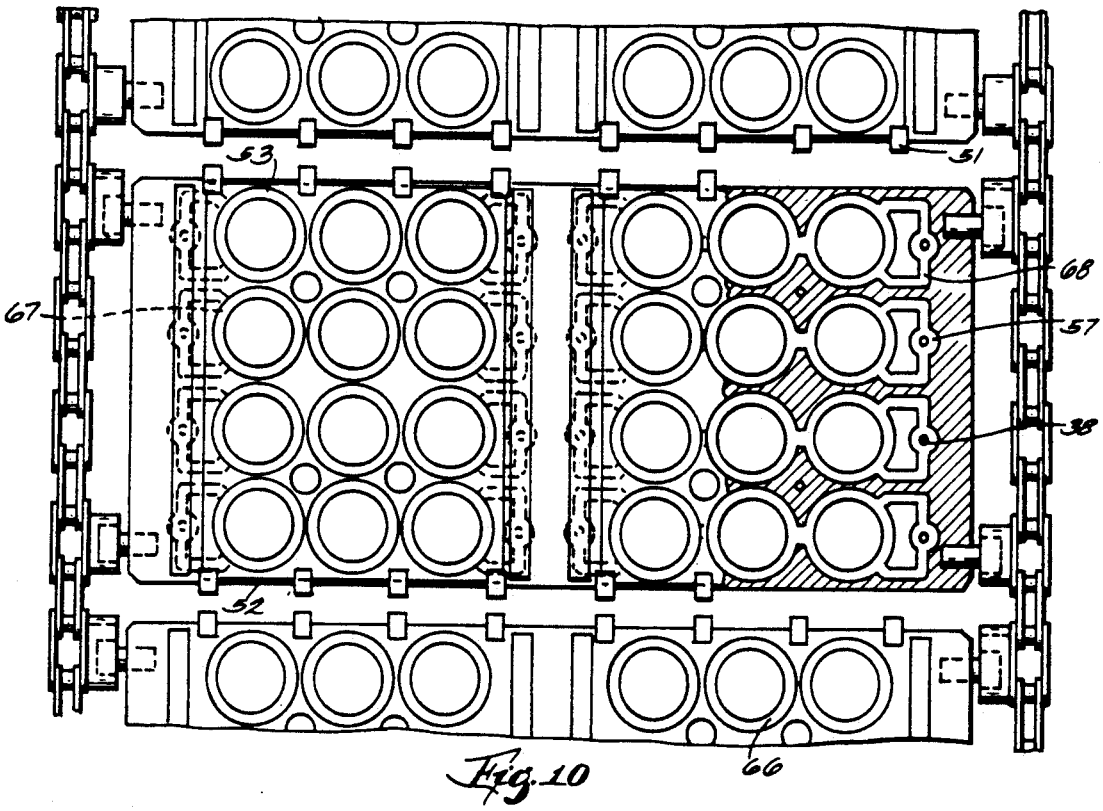
FIG. 10 is a fragmentary top plan view of one row of the forming die plates as they move through the apparatus of the present invention.
Figure 9:
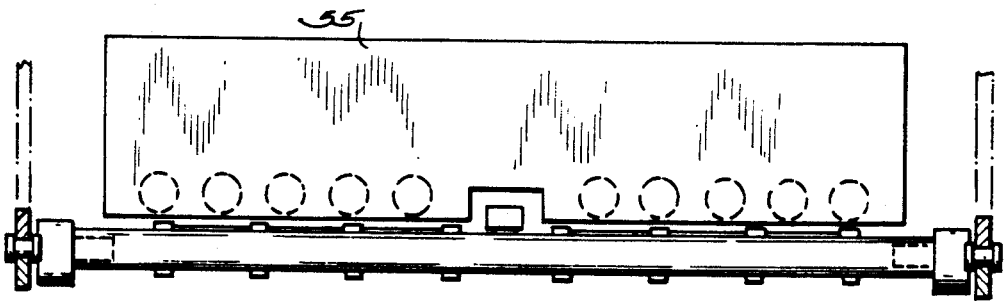
FIG. 9 is a cross-sectional view taken generally along lines 9—9 of FIG. 5.
Figure 12:
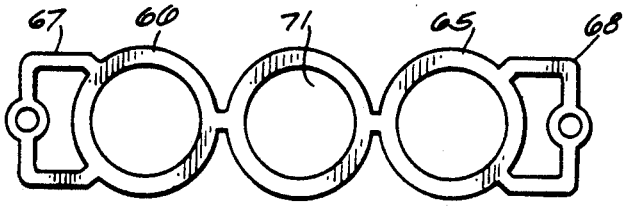
FIG. 12 is a plan view of one of the heat-masks of the forming die plates.

The mask 65 shown particularly in FIG. 12, but also in FIGS. 10 and 13, includes a series of rings 66 supported on brackets 67 and 68. The masks 65 fit within the forming plates 39 as shown particularly in FIGS. 13*a*, 13*b*, 13*c* and 13*d*.

When the plastic sheet 40 is held in place against the underside of the forming plate 39 by the clamps 51, the radiant heat from the heaters 55, which is directed against the plate 39 in the direction of the arrows 69, impinges directly against the central portion 70 of the plastic sheet 40.

Figure 13B:
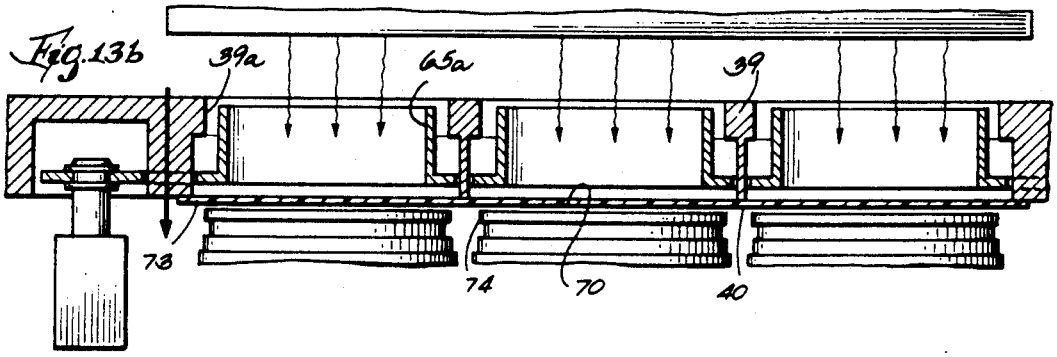

Then when the plastic sheet is brought into contact with the containers as shown in FIG. 13*b*, the upper portion of the cans push the portion 70 of the plastic sheet upwardly automatically, and the forming plate 39 pushes the unheated portion of the plastic downwardly as at 73, causing it to snap beneath the chine 74 of each of the cans.

Figure 13C:
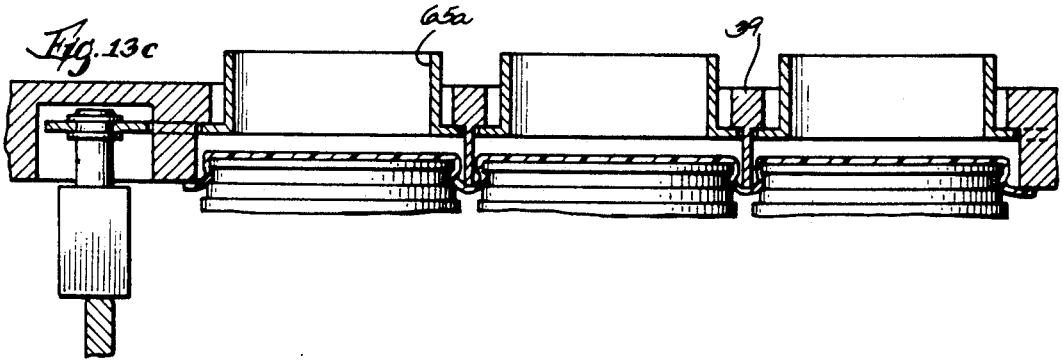
Figure 13D:
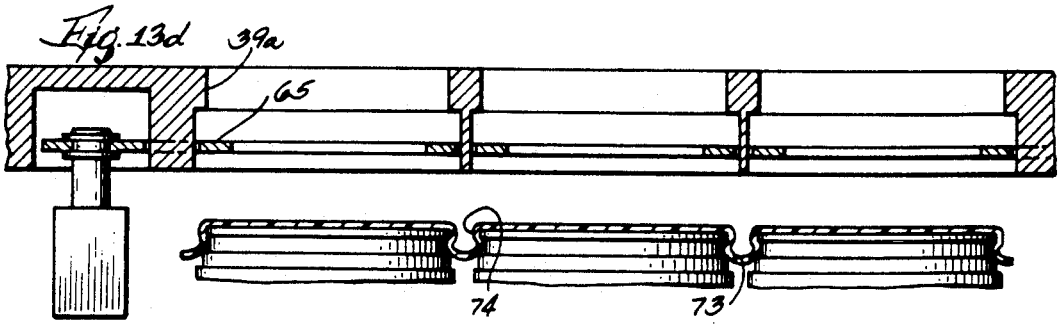

This snapping action securely locks the plastic material around and beneath the chine 74, as shown in FIG. 13*c*, and then when the array of containers is released from the forming plate 39 as shown in FIG. 13*d*, the deformed plastic sheet 40 not only holds the array of containers securely in place, but also covers the top of each of the containers to provide the sanitary characteristic heretofore described.

So as to protect the forming plate 39 from being overheated by the heater 55, a polished reflector 90 may be superimposed on the plate 39, being separated therefrom by fibre washers 91 to create a heat insulating gap 92. Apertures in the reflector 90 correspond to and are in alignment with apertures in the forming plate 39.

Figure 4:
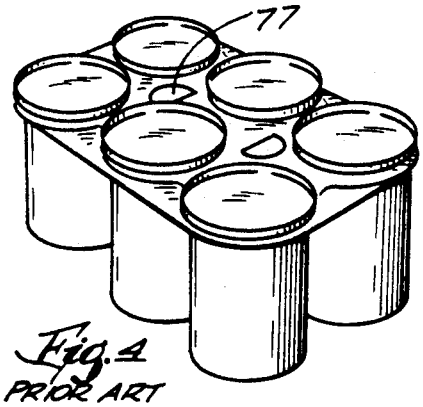
Fig. 4 PRIOR ART
FIG. 4, represents a perspective view of the single-ply protective cover-carrier shown in the Bonkowski prior art patents.

The Bonkowski prior art patent describes the completed assembly, as shown in FIG. 14, where the plastic sheet 40 is securely locked beneath the chine 74, holding the containers closely in side-by-side arrangement as at 75 while yet having the upper surface 76 in parallel arrangement so that all of the cans hang in close parallel arrangement when the cover-carrier is lifted as by the fingerholes 77 shown in FIG. 4. FIG. 15 shows still more clearly, in its enlarged view, how the plastic material in the area 73 snaps between the chine 74.

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to indicate the scope of the invention.

Having thus described my invention, what I claim as new and desire to protect by Letters Patent are the following:

1. The method of forming a carrier-cover for a plurality of containers, each of said containers having a top, an upper lip or chine, and a sidewalll, and said carrier cover comprising a single sheet of thermo-formmable plastic material which is stiff at room temperature, said method including the steps of:

advancing an array of containers to a forming section which includes a heater, a plastic sheet supply, and a forming plate having openings therein, said forming plate including a mask having at least one ring which shields a portion of said plastic sheet and said plate adjacent the chines from said heater, positioning the forming plate between the plastic sheet and the heater, bringing the plastic sheet into contact with the forming plate, heating a portion of said plastic sheet by said heater so that only selected areas thereof, which are smaller than the tops of the containers and substantially smaller than the openings in the forming plate, are softened, moving said mask closely adjacent the plastic sheet as said sheet comes close to the tops of the containers while the forming plate moves the unheated portion of the plastic sheet into contact with the containers beneath the chines, causing the tops of the containers to move against the softened portions of the plastic sheet while simultaneously causing the forming plate to move the unheated portions of the plastic sheet beyond the chines, thereby stretching the heated portion of the plastic sheet across the tops of the containers and causing unheated portions of the plastic sheet adjacent the heated portions to snap beneath the chines to form an assembled array of containers and plastic sheet, and moving the assembled array of containers and plastic sheet from the forming section.

2. A machine for forming a carrier-cover and assembling it onto a plurality of containers, each of said containers having a top, an upper lip or chine, and a side-walll, said carrier- cover comprising a sheet of thermoformable plastic material which is stiff at room temperature, said machine including:

a grouper for supplying an array of containers, a carrier for advancing said array of containers through said machine, a plastic sheet supply, a forming plate, a conveyor for supplying a plastic sheet from said sheet supply to the forming plate, grippers for securing the plastic sheet to the forming plate, a heater for softeninng selected portions of said plastic sheet, a conveyor for moving said forming plate between the heater and the plastic sheet, masking means adjacent said forming plate arranged to prevent areas of the plastic sheet and forming plate in alignment with but smaller than the tops of the containers from being heated by said heater, said masking means having at least one ring which shields a portion of said plastic sheet and said plate adjacent the chines from said heater, lifters for moving the tops of the containers against softened areas of the plastic sheet, pusher means on said forming plate for moving the un-softened portions of the plastic sheet into snap-contact with the containers beneath the chines.

* * * * *